US007753665B2

(12) United States Patent
Mosemann et al.

(10) Patent No.: US 7,753,665 B2
(45) Date of Patent: Jul. 13, 2010

(54) SCREW COMPRESSOR FOR WORKING PRESSURES ABOVE 80 BAR

(75) Inventors: Dieter Mosemann, Schildow (DE); Dmytro Zaytsev, Berlin (DE)

(73) Assignee: Grasso GmbH Refrigeration Technology, Berlin (DE)

( * ) Notice: Subject to any disclaimer, the term of this patent is extended or adjusted under 35 U.S.C. 154(b) by 0 days.

(21) Appl. No.: 11/801,189

(22) Filed: May 9, 2007

(65) Prior Publication Data

US 2008/0031762 A1 Feb. 7, 2008

(30) Foreign Application Priority Data

Aug. 1, 2006 (DE) ..... 10 2006 035 782

(51) Int. Cl.
*F03C 2/00* (2006.01)
*F03C 4/00* (2006.01)

(52) U.S. Cl. ..... 418/201.3; 418/201.1

(58) Field of Classification Search ..... 418/201.1, 418/201.3

See application file for complete search history.

(56) References Cited

U.S. PATENT DOCUMENTS 2,804,260 A * 8/1957 Nilsson et al. ..... 418/201.1
3,787,154 A * 1/1974 Edstrom ..... 418/201.3
3,807,911 A * 4/1974 Caffrey ..... 418/201.1
4,080,119 A * 3/1978 Eriksson ..... 418/201.1
4,140,445 A * 2/1979 Schibbye ..... 418/201.3
4,412,796 A * 11/1983 Bowman ..... 418/201.3
4,527,967 A * 7/1985 Ingalls ..... 418/201.3
RE32,055 E * 12/1985 Schibbye et al. ..... 418/1
4,643,654 A * 2/1987 Rinder ..... 418/201.3
4,938,672 A * 7/1990 Ingalls ..... 418/201.3
5,096,399 A 3/1992 Mosemann
5,269,667 A * 12/1993 Mauney ..... 418/201.1
6,328,546 B1 * 12/2001 Kishi et al. ..... 418/201.3
6,519,967 B1 2/2003 Mosemann et al.
2007/0264146 A1 11/2007 Mosemann et al.
2008/0085207 A1 4/2008 Mosemann et al.

FOREIGN PATENT DOCUMENTS

GB 1335025 * 10/1973

OTHER PUBLICATIONS

U.S. Appl. No. 11/801,190, filed May 9, 2007, Dieter Mosemann et al.
U.S. Appl. No. 11/801,188, filed May 9, 2007, Dieter Mosemann et al.

* cited by examiner

*Primary Examiner*—Theresa Trieu
(74) *Attorney, Agent, or Firm*—Horst M. Kasper

(57) ABSTRACT

On screw compressors for extremely high discharge pressures, e.g. for application in refrigeration systems operating with $CO_2$ in a transcritical process, featuring two rotors, a male rotor and a female rotor having a ratio of male-to-female rotor lobes of 4:6, 5:6 or 5:7, with the male rotor having a drive-shaft end, and both rotors are enclosed in a housing, the wrap angle of the profile section of the male rotor is less than 1.5 the lobe-pitch angle, and the working cycle from the beginning of suction till the end of discharge is less than 600° of the angle of rotation of the male rotor, and the length-to-diameter ratio of the profile section of the male rotor lies between 0.3 and 0.5.

17 Claims, 4 Drawing Sheets

SCREW COMPRESSOR FOR WORKING PRESSURES ABOVE 80 BAR

(g) BRIEF SUMMARY OF THE INVENTION

Figure 1:
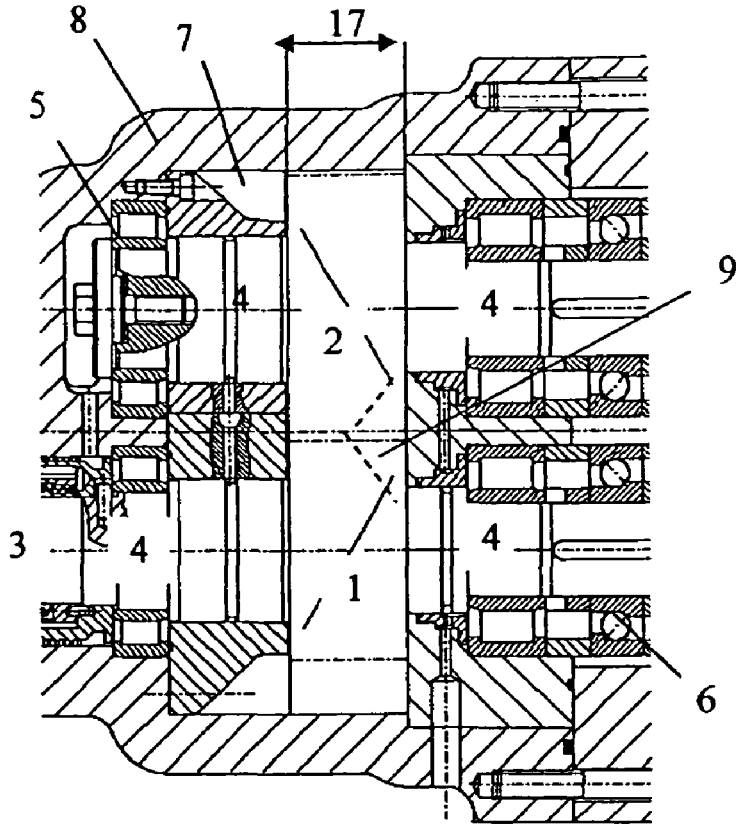

The invention relates to a screw compressor for compressing a working fluid to an extremely high discharge pressure, e.g. for application in refrigeration systems operating with $CO_2$ in a transcritical process, featuring two parallel rotors, a male rotor having essentially a convex-shaped lobe profile and a female rotor having essentially a concave-shaped lobe profile. The male rotor has a drive-shaft end. Both rotors are enclosed in a housing featuring at least one inlet port for passing of the working fluid into the cavities of the rotor pair and at least one outlet port for gas outlet from the cavities of the rotor pair due to rotation of the rotors. The profile sections of the rotors have shafts enclosed in radial bearings, which catch the radial forces and axial bearings, which catch the resulting axial forces.

The screw compressors used so far having four or five lobes on the male rotor and six or seven lobes on the female rotor with a wrap angle on the male rotor of approx. 300° are not capable to withstand extremely high working pressures exceeding 80 bar, as the rotor bearings do not achieve an acceptable service life due to high loads (see U.S. Pat. No. 4,412,796, U.S. Pat. No. 3,787,154, U.S. Pat. No. 4,080,119, U.S. Pat. No. 5,269,667).

The wrap angle is the angle between the two end face sides of the rotor profile measured around the rotor axis, the wrap angle represents the twist of rotor profile between the suction and discharge end faces.

Compressors with a greater number of lobes have been developed for high pressure applications and introduced into the market having a ratio of male-to-female rotor lobes of 6:8 and a wrap angle of approx. 300° at the profile section of the male rotor.

These compressors have smaller volumes of the working cavities. Hence, the loads on both the radial- and axial bearings are less compared to the first-mentioned compressors having ratios of male-to-female rotor lobes of 4:6 or 5:6 or 5:7 respectively. A drawback is that the internal leakages of compressors of this version increase compared to the first-mentioned compressors having greater cavity volumes and ratios of male-to-female rotor lobes of 4:6, 5:6 or 5:7.

The internal leakages depend on a geometric relationship between the rotor meshing line length and the lobe volume and increase on compressors having a ratio of male-to-female rotor lobes of 6:8 by the factor 2 to 3 in comparison with the first-mentioned compressors so that the efficiency, i.e. the volumetric efficiency, and the isentropic efficiency of the compressor, will be reduced.

The object of the invention is to prevent the disadvantages mentioned and to generate a screw compressor wherein the internal leakages do not increase and the bearing loads are brought into a range so as to achieve a sufficient service life required for industrial applications.

The feature of the invention is that two parallel rotors have a ratio of male-to-female rotor lobes of 4:6, 5:6 or 5:7 and a wrap angle is smaller than 1.5 of the lobe-pitch angle. The lobe pitch angle is the ratio of 360° divided by the number of rotor lobes.

The present invention furnishes a screw compressor for extremely high discharge pressures, for application in refrigeration systems operating on $CO_2$ in a transcritical process, featuring two rotors forming a rotor pair, a male rotor and a female rotor having a ratio of male-to-female rotor lobes of 4:6, 5:6 or 5:7, with the male rotor having a driving-shaft, and both rotors being enclosed in a housing featuring an inlet port for passing of working fluid into cavities of the rotor pair and an outlet port for discharge of gas out of the cavities of the rotor pair due to rotation of the rotors, with profile sections of the rotors having shaft shoulders enclosed in radial bearings, and resulting axial forces being supported by axial bearings. A wrap angle of the profile section of the male rotor is less than 1.5 times a lobe-pitch angle of the male rotor, and a working cycle from a beginning of suction till an end of discharge is less than 600° of an angle of rotation of the male rotor.

Preferably, a transfer phase has approximately double the magnitude of the lobe-pitch angle of the male-rotor profile. An economizer connection can be arranged between the inlet port and outlet port in the compressor housing. The economizer connection can be so arranged on the housing enclosing the rotors that there is one flow connection to each of the cavities of the male-rotor- and female-rotor profile sections also during a transfer phase. An economizer connection can be arranged on the housing enclosing the rotors in a manner that a flow connection exists exclusively during a transfer phase. A length-to-diameter ratio of the profile section of the male rotor can lie between 0.3 and 0.5. The inlet port is constructed such that a connection to the lobes of the rotor pair closes during a transfer phase.

Preferably, the wrap angle of the male rotor profile for a ratio of male-to-female rotor lobes of 5:6 or 5:7 will be approx. 1.4 times the lobe-pitch angle. The axial length of the profile section of the rotor pair approximately corresponds to 1.4 times the value of the axial lobe pitch. Preferably, the wrap angle of the male rotor profile for a ratio of male-to-female rotor lobes of 4:6 will be approx. 1.1 times the lobe-pitch angle. The axial length of the profile section of the rotor pair approximately corresponds to 1.1 times the value of the axial lobe pitch.

Preferably, the compressor according to the invention has on the profile section of the male rotor a wrap angle of approx. 100°.

A further feature is that the working cycle in comparison to known screw compressors (approx. 750°) from the beginning of the suction, through the internal compression and to the end of the discharge process will be reduced to approx. 550°.

A further feature is that the length-to-diameter ratio of the profile section of the male rotor lies between 0.3 and 0.5.

Another feature is that between the suction process and the beginning of the compression process there is a characteristic transfer phase of the working fluid. During the transfer phase there is no change of the geometric volume of the working cavity and there is no internal compression. Preferably, the inlet port has been designed so that it closes only after beginning of the transfer phase. On screw compressors having an economizer connection arranged between the inlet port and outlet port in the compressor housing, the economizer flow will get a connection to the working cavities which are in the transfer phase of the working fluid.

(h) BRIEF DESCRIPTION OF THE SEVERAL VIEWS OF THE DRAWING(S)

Figure 2:
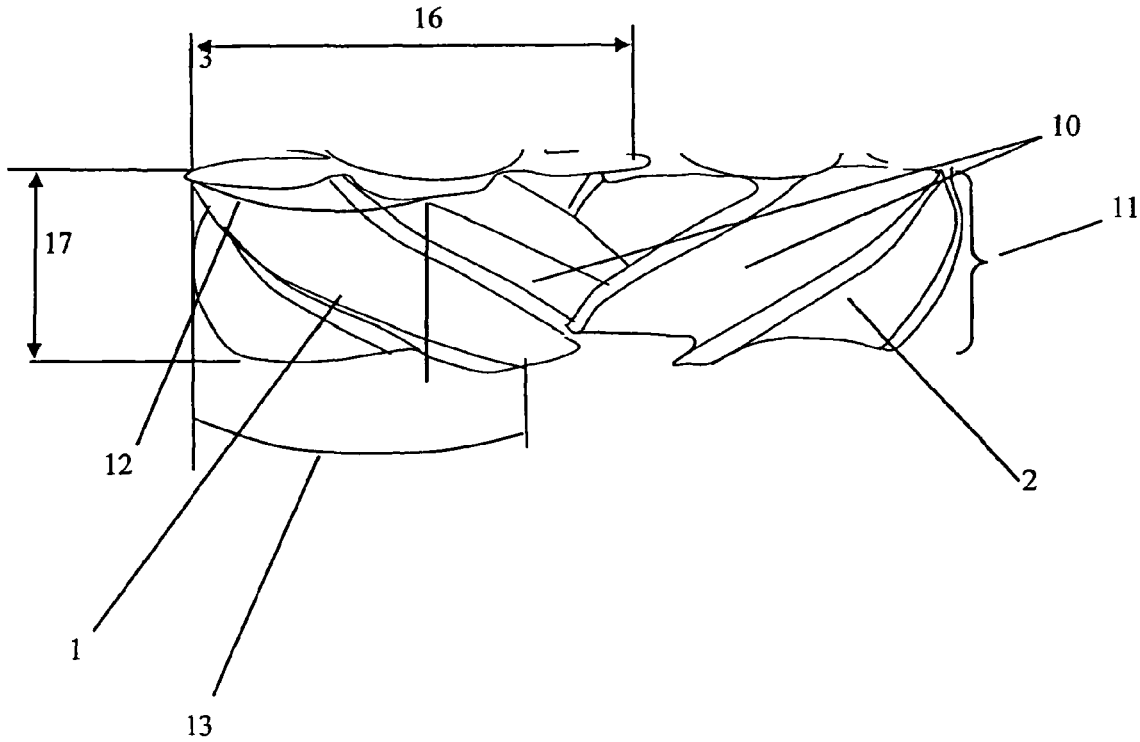
Figure 3:
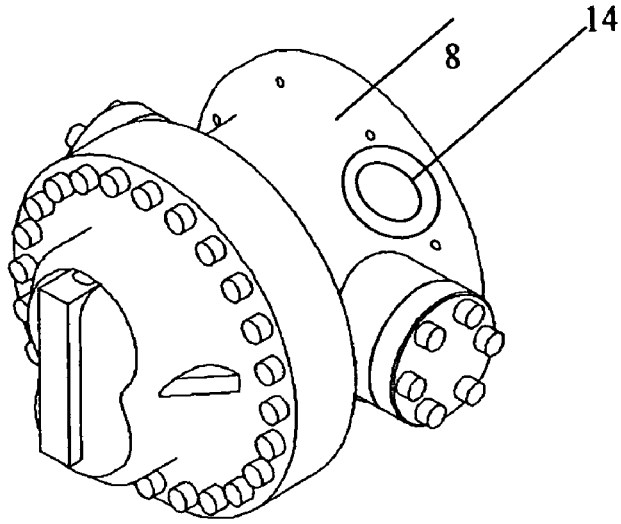
Figure 4:
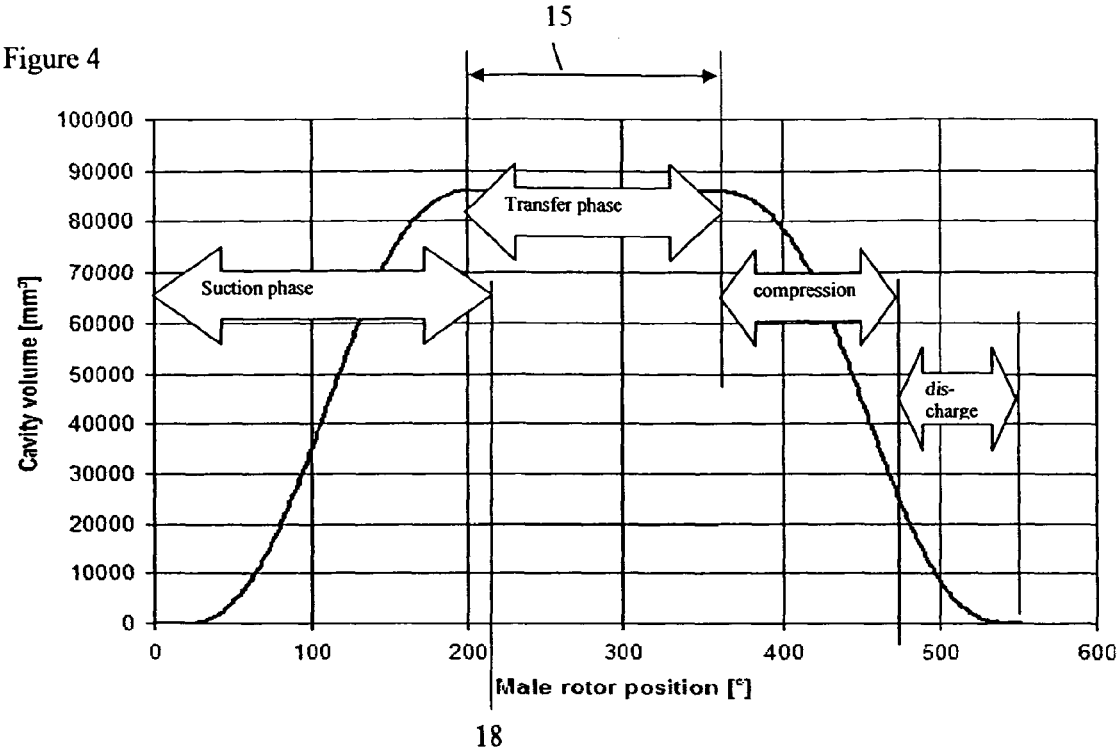

FIG. 1 shows a cross section of the screw compressor regarding the invention FIG. 2 shows the rotor pair FIG. 3 shows the screw compressor housing FIG. 4 shows the cavity volume, as a function of the male rotor position FIG. 1 shows a screw compressor according to the invention for compression of a working fluid to a discharge pressure of 100 bar, e.g. for application in refrigeration systems operating with $CO_2$ in a transcritical process featuring two rotors, a male rotor 1 and a female rotor 2 with the male rotor 1 having a drive-shaft end 3, and both rotors are enclosed in a housing 8 featuring at least an inlet port 7 for passing of the working fluid into the lobes of the rotor pair and at least an outlet port 9 for discharge of the gas due to rotation of the rotors. The profile sections of the rotors have shaft shoulders 4 enclosed in radial bearings 5 with the resulting axial forces being supported by axial bearings 6.

The profile section of male rotor 1 has five lobes, while profile section of the female rotor 2 has six lobes. The wrap angle of the male-rotor profile section is 1.4 times the value of the lobe-pitch angle and amounts to 100°. The axial length of the profile section of the rotor pair has the value of 1.4 times the axial lobe pitch of the male rotor.

For this case of operation, the bearings of the compressor according to the invention have been dimensioned sufficiently large. The service life of the bearings meets the requirements.

The internal leakage demonstrated by a geometrical relationship between the length of the rotor meshing line and the volume of the cavity is less by the factor 2 to 3 compared to known high-pressure screw compressors having a ratio of male-to-female rotor lobes of 6:8 so that the efficiency of the compressor according to the invention is higher than that of known high-pressure screw compressors.

LIST OF REFERENCE NUMBERALS USED

1 male rotor
2 female rotor
3 driving shaft
4 shaft
5 radial bearing
6 axial bearing
7 inlet port
8 housing
9 outlet port
10 cavities
11 profile section
12 lobe pitch angle
13 wrap angle
14 economizer connection
15 transfer phase
16 male rotor diameter
17 profile length
18 connection to inlet port closes

What we claim is:

1. Screw compressor for extremely high discharge pressures, for application in refrigeration systems operating on $CO_2$ in a transcritical process, featuring two rotors forming a rotor pair, a male rotor and a female rotor having a ratio of male-to-female rotor lobes of 4:6, 5:6 or 5:7, with the male rotor having a driving-shaft, and both rotors being enclosed in a housing featuring an inlet port for passing of the working fluid into cavities of the rotor pair and an outlet port for discharge of the gas out of the cavities of the rotor pair due to rotation of the rotors, with profile sections of the rotors having shaft shoulders enclosed in radial bearings, and the resulting axial forces being supported by axial bearings, wherein the wrap angle of the profile section of the male rotor is less than 1.5 times the lobe-pitch angle of the male rotor, and the working cycle from the beginning of suction till the end of discharge is less than 600° of the angle of rotation of the male rotor.

2. Screw compressor according to claim 1, wherein a transfer phase has approximately double the magnitude of the lobe-pitch angle of the male-rotor profile.

3. Screw compressor according to claim 1 with an economizer connection arranged between the inlet port and outlet port in the compressor housing, wherein the economizer connection is so arranged on the housing enclosing the rotors that there is one flow connection to each of the cavities of the male-rotor-and female-rotor profile sections also during the transfer phase.

4. Screw compressor according to claim 1 wherein the economizer connection is arranged on the housing enclosing the rotors in a manner that the flow connection exists exclusively during the transfer phase.

5. Screw compressor according to claim 1 wherein a length-to-diameter ratio of the profile section of the male rotor lies between 0.3 and 0.5.

6. Screw compressor according to claim 1 wherein the inlet port is designed so that the connection to the lobes of the rotor pair closes during the transfer phase.

7. A screw compressor for extremely high discharge pressures comprising a male rotor;

a female rotor, wherein the male rotor and the female rotor form a rotor pair, wherein the male rotor and the female rotor have a ratio of male-to-female rotor lobes of 4:6, 5:6 or 5:7;

a driving-shaft formed at the male rotor;

a housing enclosing both rotors, wherein the housing features an inlet port for passing of working fluid into cavities of the rotor pair and an outlet port for discharge of gas out of the cavities of the rotor pair due to rotation of the rotors;

profile sections formed at the rotors having shaft shoulders enclosed in radial bearings, and resulting axial forces being supported by axial bearings, wherein a length-to-diameter ratio of the profile section of the male rotor lies between 0.3 and 0.5, and wherein a wrap angle of the profile section of the male rotor is less than 1.5 times a lobe-pitch angle of the male rotor, and wherein a working cycle from a beginning of suction till an end of discharge is less than 600° of an angle of rotation of the male rotor.

8. The screw compressor according to claim 7 further comprising an economizer connection arranged between the inlet port and outlet port in the compressor housing, wherein the economizer connection is so arranged on the housing enclosing the rotors that there is one flow connection to each of the cavities of the male-rotor-and female-rotor profile sections also during a transfer phase.

9. The screw compressor according to claim 7, further comprising an economizer connection is arranged on the housing enclosing the rotors in a manner that a flow connection exists exclusively during a transfer phase.

10. The screw compressor according to claim 7 wherein the inlet port is constructed so that a connection to the lobes of the rotor pair closes during a transfer phase.

11. The screw compressor according to claim 7, wherein the screw compressor is applied in refrigeration systems operating on $CO_2$ in a transcritical process.

12. A screw compressor for extremely high discharge pressures comprising a male rotor;

a female rotor, wherein the male rotor and the female rotor form a rotor pair, wherein the male rotor and the female rotor have a ratio of male-to-female rotor lobes of 4:6, 5:6 or 5:7;

a driving-shaft formed at the male rotor;

a housing enclosing both rotors, wherein the housing features an inlet port for passing of working fluid into cavities of the rotor pair and an outlet port for discharge of gas out of the cavities of the rotor pair due to rotation of the rotors;

profile sections formed at the rotors having shaft shoulders enclosed in radial bearings, and resulting axial forces being supported by axial bearings, wherein a transfer phase has approximately double a magnitude of a lobe-pitch angle of the male-rotor profile.

13. The screw compressor according to claim 12 wherein a wrap angle of the profile section of the male rotor is less than 1.5 times the lobe-pitch angle of the male rotor, and wherein a working cycle from a beginning of suction till an end of discharge is less than 600° of an angle of rotation of the male rotor.

14. The screw compressor according to claim 12 further comprising an economizer connection arranged between the inlet port and outlet port in the compressor housing, wherein the economizer connection is so arranged on the housing enclosing the rotors that there is one flow connection to each of the cavities of the male-rotor-and female-rotor profile sections also during a transfer phase.

15. The screw compressor according to claim 12, further comprising an economizer connection is arranged on the housing enclosing the rotors in a manner that a flow connection exists exclusively during a transfer phase.

16. The screw compressor according to claim 12 wherein the inlet port is constructed so that a connection to the lobes of the rotor pair closes during a transfer phase.

17. The screw compressor according to claim 12, wherein the screw compressor is applied in refrigeration systems operating on $CO_2$ in a transcritical process.

* * * * *